US010599081B2

(12) United States Patent
Tachi et al.

(10) Patent No.: US 10,599,081 B2
(45) Date of Patent: Mar. 24, 2020

(54) IMAGE FORMING APPARATUS AND VOLTAGE APPLICATION METHOD

(71) Applicants: Masashi Tachi, Kanagawa (JP); Takuma Higa, Kanagawa (JP); Masayoshi Nakayama, Ibaraki (JP); Masaki Sukesako, Kanagawa (JP); Tomohide Takenaka, Kanagawa (JP); Yuichi Aizawa, Kanagawa (JP); Kazuaki Kamihara, Tokyo (JP); Keita Sone, Tokyo (JP)

(72) Inventors: Masashi Tachi, Kanagawa (JP); Takuma Higa, Kanagawa (JP); Masayoshi Nakayama, Ibaraki (JP); Masaki Sukesako, Kanagawa (JP); Tomohide Takenaka, Kanagawa (JP); Yuichi Aizawa, Kanagawa (JP); Kazuaki Kamihara, Tokyo (JP); Keita Sone, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/103,472

(22) Filed: Aug. 14, 2018

(65) Prior Publication Data

US 2019/0064719 A1 Feb. 28, 2019

(30) Foreign Application Priority Data

Aug. 25, 2017 (JP) ..... 2017-162245

(51) Int. Cl.
*G03G 15/16* (2006.01)
*G03G 15/00* (2006.01)
(Continued)

(52) U.S. Cl.
CPC ..... *G03G 15/5037* (2013.01); *G03G 15/065* (2013.01); *G03G 21/1676* (2013.01); *G03G 15/0266* (2013.01)

(58) Field of Classification Search
CPC ..... G03G 2215/0634; G03G 15/0856; G03G 15/0233; G03G 21/0023
See application file for complete search history.

(56) References Cited

U.S. PATENT DOCUMENTS

2004/0253015 A1* 12/2004 Kitajima ..... G03G 15/0131 399/66
2006/0133834 A1 6/2006 Yoneda et al.
(Continued)

FOREIGN PATENT DOCUMENTS

| | | |
|---|---|---|
| JP | 2002-062326 | 2/2002 |
| JP | 2006-139112 | 6/2006 |
| JP | 2010-262316 | 11/2010 |

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An image forming apparatus includes a latent image bearer to bear a latent image, a potential sensor having a vibrator driven by a drive frequency to detect a surface potential of the latent image bearer, a developer bearer to bear developer that develops the latent image on the latent image bearer, and a power supply to apply a superimposed voltage obtained by superimposing an alternating voltage on a direct current voltage on the developer bearer. The frequency of the alternating voltage is not a multiple of the drive frequency and is a value obtained by adding a predetermined value to a multiple of the driving frequency.

18 Claims, 7 Drawing Sheets

(51) Int. Cl.

| | |
|---|---|
| ***G03G 21/16*** | (2006.01) |
| ***G03G 15/06*** | (2006.01) |
| *G03G 15/02* | (2006.01) |

(56) References Cited

U.S. PATENT DOCUMENTS

| | | | | |
|---|---|---|---|---|
| 2009/0252514 | A1* | 10/2009 | Tanaka | G03G 15/0812 399/55 |
| 2010/0247190 | A1* | 9/2010 | Shirai | G03G 21/0047 399/350 |
| 2010/0316402 | A1* | 12/2010 | Oba | G03G 15/0812 399/55 |
| 2014/0233989 | A1* | 8/2014 | Hara | G03G 15/0189 399/301 |

* cited by examiner

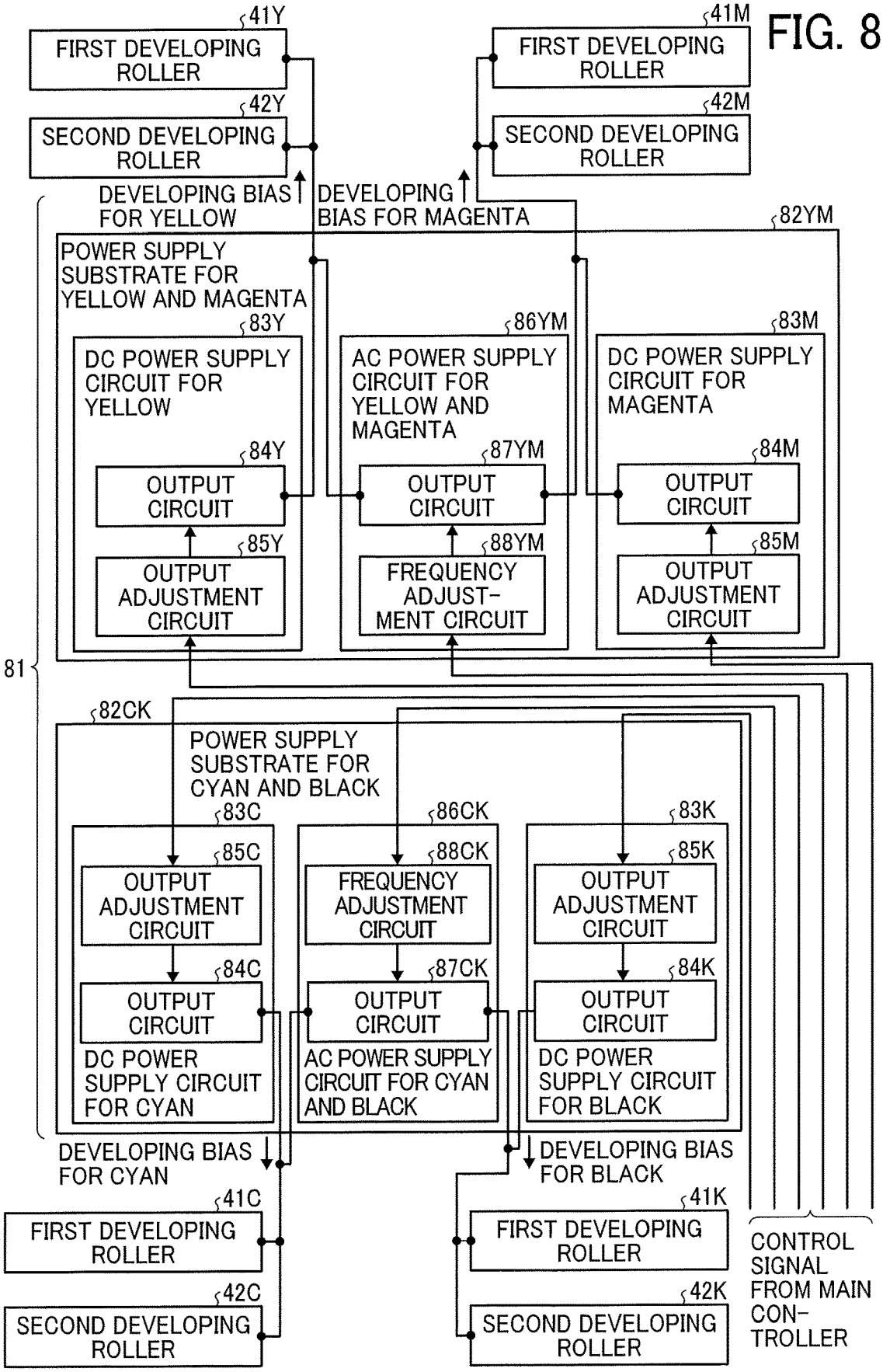
FIG. 8
41Y
FIRST DEVELOPING ROLLER
42Y
SECOND DEVELOPING ROLLER
41M
FIRST DEVELOPING ROLLER
42M
SECOND DEVELOPING ROLLER
DEVELOPING BIAS FOR YELLOW
DEVELOPING BIAS FOR MAGENTA
82YM
POWER SUPPLY SUBSTRATE FOR YELLOW AND MAGENTA
83Y
DC POWER SUPPLY CIRCUIT FOR YELLOW
84Y
OUTPUT CIRCUIT
85Y
OUTPUT ADJUSTMENT CIRCUIT
86YM
AC POWER SUPPLY CIRCUIT FOR YELLOW AND MAGENTA
87YM
OUTPUT CIRCUIT
88YM
FREQUENCY ADJUST-MENT CIRCUIT
83M
DC POWER SUPPLY CIRCUIT FOR MAGENTA
84M
OUTPUT CIRCUIT
85M
OUTPUT ADJUSTMENT CIRCUIT
81
82CK
POWER SUPPLY SUBSTRATE FOR CYAN AND BLACK
83C
85C
OUTPUT ADJUSTMENT CIRCUIT
84C
OUTPUT CIRCUIT
DC POWER SUPPLY CIRCUIT FOR CYAN
86CK
88CK
FREQUENCY ADJUSTMENT CIRCUIT
87CK
OUTPUT CIRCUIT
AC POWER SUPPLY CIRCUIT FOR CYAN AND BLACK
83K
85K
OUTPUT ADJUSTMENT CIRCUIT
84K
OUTPUT CIRCUIT
DC POWER SUPPLY CIRCUIT FOR BLACK
DEVELOPING BIAS FOR CYAN
DEVELOPING BIAS FOR BLACK
41C
FIRST DEVELOPING ROLLER
42C
SECOND DEVELOPING ROLLER
41K
FIRST DEVELOPING ROLLER
42K
SECOND DEVELOPING ROLLER
CONTROL SIGNAL FROM MAIN CON-TROLLER

FIG. 9

| | | DRIVE FREQUENCY FOR SURFACE POTENTIAL SENSOR 8K [Hz] | | | | | |
|---|---|---|---|---|---|---|---|
| | | 650-669 | 670-685 | 686-700 | 701-725 | 726-742 | 743-750 |
| DRIVE FREQUENCY FOR SURFACE POTENTIAL SENSOR 8C [Hz] | 650-669 | B | A | B | B | A | B |
| | 670-685 | A | A | C | A | A | C |
| | 686-700 | B | C | B | B | C | B |
| | 701-725 | B | A | B | B | A | B |
| | 726-742 | A | A | C | A | A | C |
| | 743-750 | B | C | B | B | C | B |

A: 9000Hz
B: 8800Hz
C: 9200Hz

IMAGE FORMING APPARATUS AND VOLTAGE APPLICATION METHOD

CROSS-REFERENCE TO RELATED APPLICATION

This patent application is based on and claims priority pursuant to 35 U.S.C. § 119 to Japanese Patent Application No. 2017-162245, filed on Aug. 25, 2017 in the Japanese Patent Office, the entire disclosure of which is hereby incorporated by reference herein.

BACKGROUND

Technical Field

This disclosure relates to an image forming apparatus and a voltage application method.

Description of the Related Art

Some known image forming apparatuses include an electric potential sensor to detect a surface potential of a latent image bearer and a power source to apply to a developer bearer a superimposed voltage in which an alternating current voltage is superimposed on a direct current voltage for developing a latent image.

SUMMARY

This specification describes an improved image forming apparatus that includes a latent image bearer to bear a latent image, a potential sensor having a vibrator driven by a drive frequency to detect a surface potential of the latent image bearer, a developer bearer to bear developer that develops the latent image on the latent image bearer, and a power supply to apply a superimposed voltage obtained by superimposing an alternating voltage on a direct current voltage on the developer bearer. The frequency of the alternating voltage is not a multiple of the drive frequency and is a value obtained by adding a predetermined value to a multiple of the driving frequency.

This specification further describes an improved voltage application method for an image forming apparatus including a potential sensor having a vibrator driven by a drive frequency and a developer bearer supplied with a superimposed voltage obtained by superimposing an alternating current voltage on a direct current voltage. The voltage application method includes setting a frequency of the alternating current voltage that is not a multiple of the drive frequency and is of a value obtained by adding a predetermined value to a multiple of the drive frequency.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 8 is a block diagram illustrating a developing power supply of the printer and developing rollers of respective colors according to the example; and FIG. 9 is a diagram for describing a data table stored in a main controller.

Figure 1:
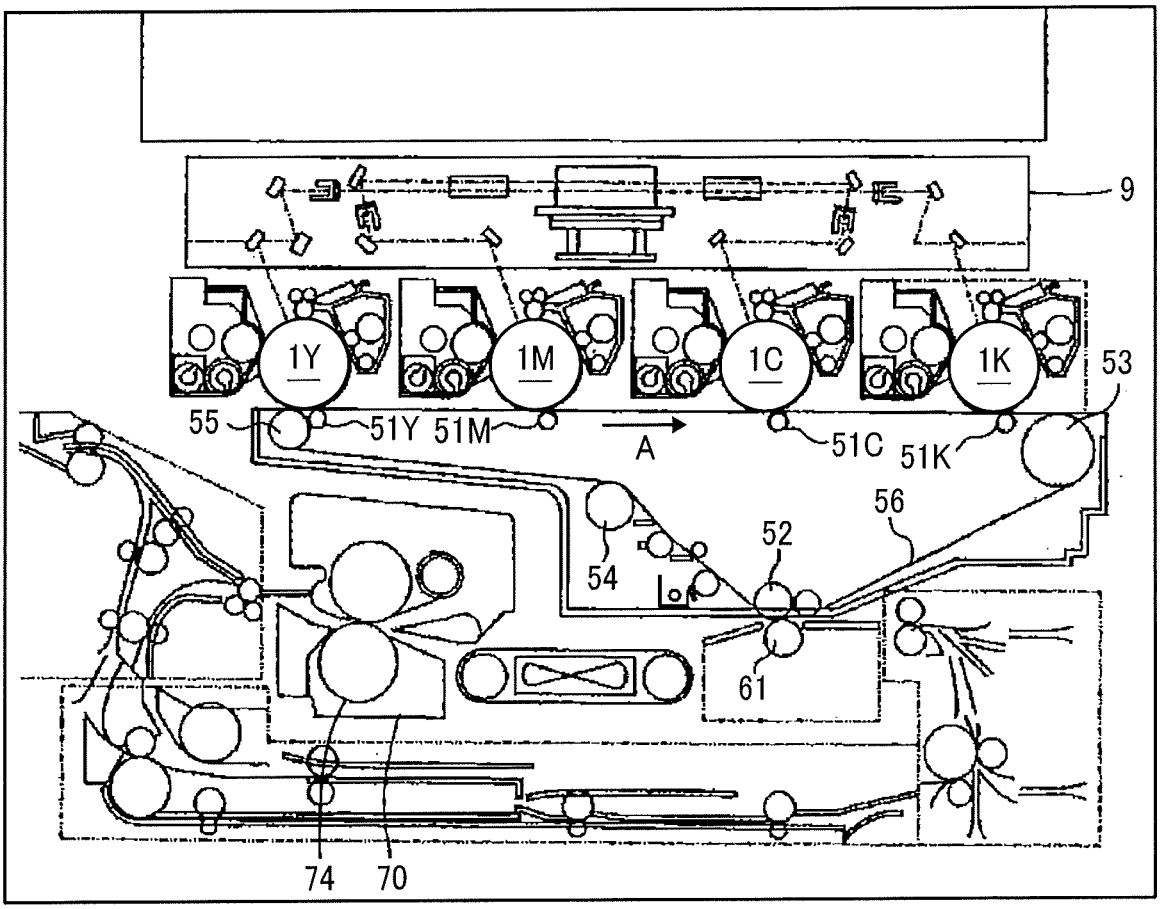
FIG. 1 is a schematic diagram illustrating a printer according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

With reference to FIG. 1, a description is provided of an electrophotographic printer as an example of an image forming apparatus according to an embodiment of the present disclosure.

FIG. 1 is a schematic diagram illustrating a basic configuration of the printer according to the embodiment. An intermediate transfer device as a transfer device is disposed substantially in the center of the interior of the printer. In this intermediate transfer device, an intermediate transfer belt 56 formed as an endless belt is wound around and supported by four rollers 55, 54, 53 and 52 inside the loop of the intermediate transfer belt 56, and rotates in the direction of arrow A in FIG. 1.

Above the intermediate transfer device, four image forming units each corresponding to toner of specific color, that is, yellow (Y), magenta (M), cyan (C), or black (K), are disposed side by side along the direction of rotation of the intermediate transfer belt 56.

Figure 2:
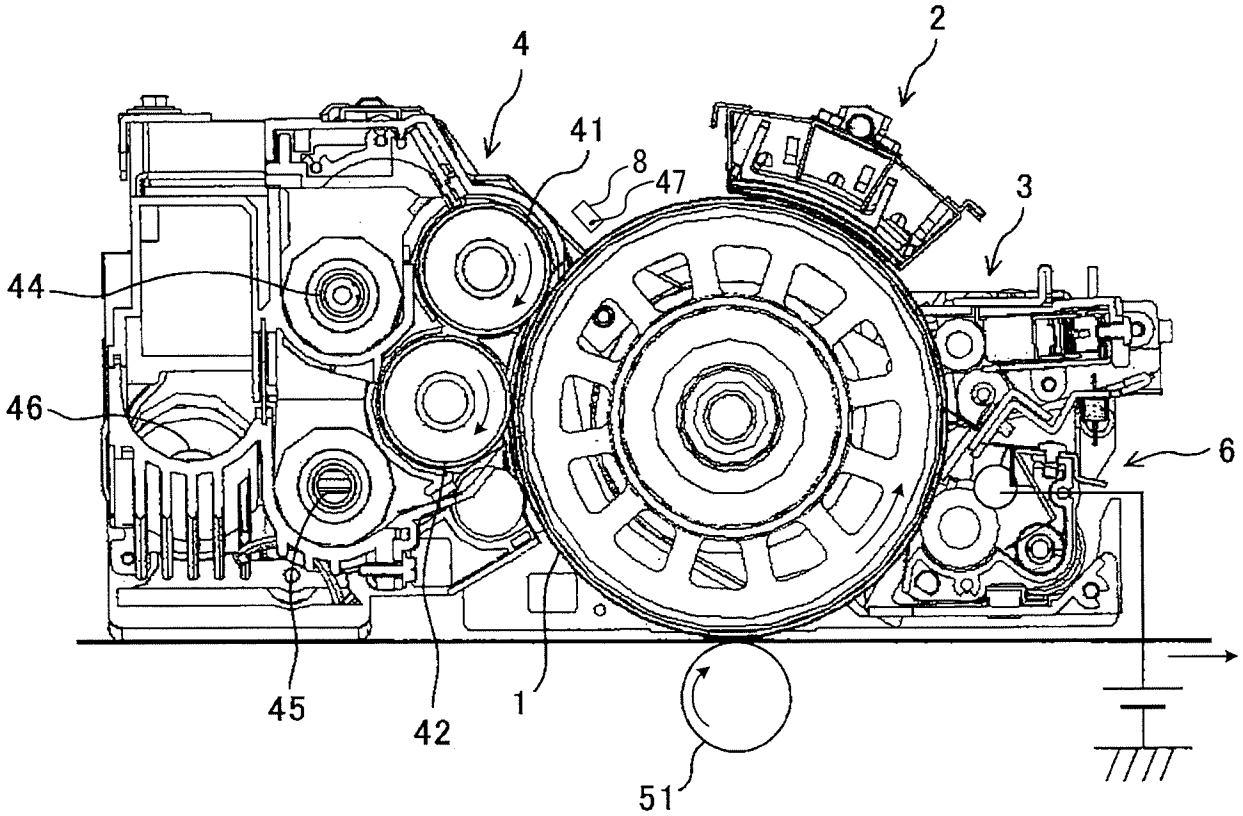
FIG. 2 is an enlarged view illustrating one of the four image forming units in the printer illustrated in FIG. 1.

FIG. 2 is an enlarged view illustrating one of the four image forming units. Since the four image forming units have the same structure, the suffixes Y, M, C, and K for color coding at the end of reference numerals are omitted in FIG. 2. The image forming unit includes a photoconductor 1 as a latent image bearer. In addition, the image forming unit includes a charging device 2, a developing device 4, a surface potential sensor 8, a cleaning device 6, and a lubricant coating device 3 around the photoconductor 1.

A motor rotates the photoconductor 1 in a direction indicated by an arrow which is a counterclockwise direction in FIG. 1. The moving direction of the intermediate transfer belt 56 and the moving direction of the surface of the photoconductor 1 are the same direction at the contact portion between the intermediate transfer belt 56 and the photoconductor 1. The moving direction of the surface of the first developing roller 41 and the moving direction of the surface of the photoconductor 1 are also in the same direction at the position where the first developing roller 41 of the developing device 4 faces the photoconductor 1, and the moving direction of the surface of the second developing roller 42 and the moving direction of the surface of the photoconductor 1 are the same at the position where the second developing roller 42 faces the photoconductor 1.

The charging device 2 uniformly charges the surface of the rotating photoconductor 1 to the same polarity of toner that is minus polarity at a position in which the charging device 2 faces the photoconductor 1. The charging device 2 illustrated in FIG. 1 employs a method of charging the surface of the photoconductor 1 by discharge between the surface of the photoconductor 1 and a wire applied a charging bias, the wire extending in a rotational axis direction of the photoconductor 1 and opposite the photoconductor 1 through a predetermined gap. Instead of this method, the charging device 2 may employ a method of charging the surface of the photoconductor 1 by discharge between the surface of the photoconductor 1 and a charging roller or a charging brush roller applied the charging bias, the charging roller or the charging brush roller contacting the photoconductor 1 or disposing near the photoconductor 1. Regardless of the charging method described above, the charging device 2 uses a superimposed voltage obtained by superimposing an alternating current (AC) voltage on a direct current (DC) voltage having the same polarity as the charging polarity of the toner as a charging bias to promote discharge.

With reference to FIG. 1, an optical writing unit 9 as a latent image forming device is disposed above the four image forming units. The optical writing unit 9 irradiates the charged surfaces of the photoconductors 1Y, 1M, 1C, and 1K with laser beams L oscillated based on image data to write electrostatic latent images thereon optically. The intermediate transfer belt 56 is clamped between the photoconductors 1Y, 1M, 1C, and 1K disposed outside the loop of the intermediate transfer belt 56 and the primary transfer rollers 51Y, 51M, 51C, and 51K disposed inside the loop of the intermediate transfer belt 56. Accordingly, four primary transfer nips for yellow, magenta, cyan, and black are formed between the four photoconductors 1Y, 1M, 1C, and 1K and the intermediate transfer belt 56, respectively.

A primary transfer power source outputs a primary transfer bias applied to the primary transfer rollers 51Y, 51M, 51C, and 51K. The primary transfer bias forms a primary transfer electric field between the photoconductors 1Y, 1M, 1C and 1K and the intermediate transfer belt 56 that electrostatically moves toner from the photoconductor to the intermediate transfer belt.

The secondary transfer roller 61 contacts an outer surface of the intermediate transfer belt 56 to form a secondary transfer nip in an area in which the intermediate transfer belt 56 is wrapped around the secondary transfer opposing roller 52 disposed in the inside of the belt loop in the entire area in the circumferential direction of the intermediate transfer belt 56. A secondary transfer power source outputs a transfer bias applied to the secondary transfer opposing roller 52. The secondary transfer bias forms a secondary transfer electric field in the secondary transfer nip that electrostatically moves toner from the intermediate transfer belt side to the secondary transfer roller 61 side.

The secondary transfer bias applied to the secondary transfer opposing roller 52 is a superimposed voltage obtained by superimposing an alternating voltage on a direct current voltage having the same polarity as the charging polarity of the toner. The direct current voltage having the same polarity as the charging polarity of the toner electrostatically moves the toner from the secondary transfer opposing roller 52 to the grounded secondary transfer roller 51.

A belt cleaning device is provided downstream from the secondary transfer roller 61 in the rotating direction of the intermediate transfer belt 56. On the left side of the secondary transfer nip in FIG. 1, a fixing device 70 is disposed to fix the toner image on a recording sheet. In addition, at the bottom of the printer, a sheet feeder is disposed to send the recording sheet toward the secondary transfer nip.

The charging device 2 in FIG. 2 uniformly charges the photoconductors 1Y, 1M, 1C, and 1K to a target charging potential that is the negative polarity in the present embodiment. When the optical writing unit 9 irradiates the photoconductor 1 with laser beam L, the electric potential at the irradiated position attenuates, and the electrostatic latent image is formed on the photoconductor 1. The developing device 4 in FIG. 2 supplies toner to the electrostatic latent image, thereby developing the latent image into a toner image.

The outer face of the intermediate transfer belt 56 sequentially passes the primary transfer nips for yellow, cyan, magenta, and black as the intermediate transfer belt 56 rotates. In the primary transfer nips, yellow, magenta, cyan, and black toner images are sequentially primarily transferred from the photoconductors 1Y, 1M, 1C, and 1K and superimposed on the intermediate transfer belt 56.

The yellow, magenta, cyan, and black toner images on the photoconductor 1Y, M, 1C, and 1K are sequentially primarily transferred in the primary transfer nips and forms a superimposed toner image. On the other hand, registration roller pair sends the recording sheet fed out from the sheet feeder to the secondary transfer nip at a predetermined timing. The recording sheet overlaps the superimposed toner image on the intermediate transfer belt 56 at the secondary transfer nip, and the nip pressure and the secondary transfer electric field secondarily transfer the superimposed toner image onto the surface of the recording sheet. After that, the superimposed toner image is sent to a fixing device 70 and fixed as a color toner image on the recording sheet.

The recording paper on which the color toner image is fixed in this manner is switched back or discharged outside the printer. When the recording sheet is switched back for duplex printing, the recording sheet is reversed and re-sent to the secondary transfer nip again, and the superimposed toner image is secondarily transferred to the other side of the recording sheet. After that, the superimposed toner image is sent to the fixing device 70 and fixed as a color toner image on the recording sheet. The recording sheet on which the color toner image is fixed is discharged outside the printer.

After passing through the secondary transfer nip, residual toner that is not transferred onto the recording sheet remains on the intermediate transfer belt 56. The belt cleaning device removes the residual toner from the intermediate transfer belt 56.

In FIG. 2, after passing through the primary transfer nip, residual toner that is not transferred onto the intermediate transfer belt 56 remains on the photoconductor 1. The cleaning device 6 removes the residual toner from the photoconductor 1.

The developing device 4 has a developer including charged toner and magnetic carrier inside, and three stirring and conveying screws 44, 45, and 46 stirs and conveys the developer in the developing device 4. The developing device 4 includes a first developing roller 41 and a second developing roller 42 as developer bearers arranged side by side along the moving direction of the surface of the photoconductor 1. Each of these developing rollers 41 and 42 includes a magnet inside a cylindrical developing sleeve. The magnet attracts the developer on the surface of the developing sleeve. Then, rotation of the developing sleeve conveys the developer to the developing area in which the developing sleeve opposes the photoconductor 1.

The first developing roller 41 bears the developer conveyed by the first stirring and conveying screw 44 among the three stirring and conveying screws 44, 45, and 46 included in the developing device 4 and rotates to convey the developer to a first developing region. The first developing roller 41 is applied a developing bias that is a superimposed voltage obtained by superimposing an alternating voltage on a direct current voltage having the same polarity as the charging polarity of the toner. The alternating current component due to the alternating current voltage included in the developing bias forms an alternating electric field that inverts the polarity at a predetermined cycle on the surface of the first developing roller 41. This alternating electric field makes it possible to promote the detachment of the toner particles from the surface of the magnetic carrier in the developer carried on the first developing roller 41, thereby enhancing the developing ability.

Since the polarity of the direct current component of the developing bias is the same as the charging polarity of the toner, the polarity of the average potential of the developing bias becomes the same polarity as the charging polarity of the toner. The absolute value of the direct current component (for example, −500 V) becomes smaller than the absolute value of the potential (for example, −650 V) of the background portion of the photoconductor 1 that is the portion not subjected to light irradiation by the optical writing unit 9 after the charging device uniformly charges the photoconductor 1. In addition, the absolute value of the direct current component is larger than the absolute value of the potential (for example, −50 V) of the electrostatic latent image borne on the photoconductor 1. Therefore, in the first developing region, a non-developing potential that electrostatically moves the toner from the photoconductor 1 to the first developing roller 41 acts between the first developing roller 41 and the background portion of the photoconductor 1. In addition, a developing potential that electrostatically moves the toner from the first developing roller 41 to the photoconductor 1 acts between the first developing roller 41 and the electrostatic latent image of the photoconductor 1. This causes the minus charged toner (for example, −30 μC/g) in the developer borne on the first developing roller 41 to selectively adhere to the electrostatic latent image on the photoconductor 1 and develop the electrostatic latent image.

The developer on the surface of the first developing roller 41 that has passed through the first developing region is delivered to the surface of the second developing roller 42. A rotation of the second developing roller 42 conveys the developer to the second developing region. Since the same developing bias as that applied to the first developing roller 41 is also applied to the second developing roller 42, the developer on the second developing roller 42 develops the electrostatic latent image on the photoconductor 1 in the same manner as the developer on the first developing roller 41. Thereafter, the developer on the second developing roller 42 is separated from the second developing roller 42 and collected into the second stirring and conveying screw. After the developer is delivered from the second stirring and conveying screw 45 to the third stirring and conveying screw 46, the developer is delivered from the third stirring and conveying screw 46 to the first stirring and conveying screw 44.

Both the first developing roller 41 and the second developing roller 42 disposed close to the first developing roller 41 and disposed downstream of the first developing roller 41 in the surface moving direction of the photoconductor 1 are disposed on the left side of the photoconductor 1 in FIG. 2 and rotates in the clockwise direction. Therefore, the surface of the first developing roller 41 and the second developing roller 42 rotates the same direction of the rotation direction of the photoconductor 1 at the developing area in which the photoconductor 1 opposes the first developing roller 41 and the second developing roller 42.

In the entire circumferential range of the photoconductor 1, the surface potential sensor 8 to detect a latent image potential and a background portion potential of the photoconductor 1 is disposed opposite the photoconductor 1 across a predetermined gap from a position in which the surface of the photoconductor 1 passes through a position opposite the charging device 2 to a position before the surface of the photoconductor 1 enters a position opposite the developing device 4. Photosensitive properties and charging properties of the photosensitive layer in the photoconductor 1 vary depending on environmental factors, such as temperature and humidity, as well as intrinsic factors such as the degree of deterioration of each layer. Therefore, if the value of the direct current component of the charging bias is simply kept constant or the intensity of the laser beam emitted from the optical writing unit 9 is simply kept constant, these variations in the properties of the photosensitive layer vary the background portion potential of the photoconductor 1 and the potential of the latent image potential. This causes unstable image density and background stains due to toner adhesion to the background portion of the photoconductor 1.

Therefore, this printer periodically performs a process of adjusting the charging bias and the intensity of the laser beam to obtain the target background portion potential and the target latent image potential based on a detection result of the background portion potential and the latent image potential by the surface potential sensor 8. In addition, this printer periodically preforms a process of adjusting the developing bias to obtain the target image density based on a result of a reflective optical sensor detecting a toner adhesion amount of a predetermined test toner image formed by the printer.

In the printer according to the embodiment, the surface potential sensor 8 is not covered with an electromagnetic shield in each of the image forming units for yellow, magenta, cyan, and black.

The surface potential sensor 8 includes a detection electrode and a tuning fork type vibrator 47 made of piezoelectric ceramics or the like. A surface electric potential on the photoconductor 1 induces a charge in the detection electrode opposite the photoconductor 1 and generates electrostatic coupling between the photoconductor 1 and the detection electrode. In this state, the tuning fork type vibrator 47 which vibrates at a predetermined drive frequency causes opening and closing movement with a period according to the drive frequency. The surface potential sensor 8 eliminates fluctuation in the amount of electric flux lines accompanying the opening and closing movement as a signal and detects the surface electric potential on the photoconductor 1 which is the background portion potential and the like. In this surface potential sensor 8, if a member different from the photoconductor 1, to which a voltage is applied, forms an electric field, the electric field changes the above-described fluctuation in the amount of electric flux lines and increases the detection error of the surface potential. This makes it difficult to keep the background portion potential and the latent image potential of the photoconductor 1 accurately at the target potential.

Providing an electromagnetic shield covering the surface potential sensor 8 makes it possible to prevent the increase in the detection error of the surface potential due to the electric field formed by the application of the voltage to the member near the surface potential sensor 8. However, providing the electromagnetic shield is costly.

As described above, the charging bias that is the superimposed voltage is applied to the wire of the charging device 2 illustrated in FIG. 2. Therefore, an electric field due to the charging bias is formed around the wire of the charging device 2. As illustrated in FIG. 2, since the charging device 2 and the surface potential sensor 8 are separated from each other, the electric field does not affect the detection accuracy of the surface potential sensor 8. On the other hand, the first developing roller 41 of the developing device 4 is disposed at a position close to the surface potential sensor 8. The distance between the axial center of the first developing roller 41 and the surface potential sensor 8 is smaller than the distance between the charging device 2 and the surface potential sensor 8. Therefore, the electric field formed around the first developing roller 41 located near the surface potential sensor 8 mainly affects the detection result.

Next, experiments conducted by the inventors are described.

First Experiment

A test printer used in the experiments has a configuration similar to that of the printer according to the present embodiment. While the test printer was idling, output data from the surface potential sensor 8K in the image forming unit for black was sampled. The developing bias that was the superimposed voltage was applied to the first developing roller 41K and the second developing roller 42K in the developing device 4K for black. The following condition was satisfied with respect to the frequency fc of the AC component of the developing bias and the drive frequency fvsen of the tuning fork vibrator 47 of the surface potential sensor 8K. That is, the condition is "fc=fvsen×12".

Figure 3:
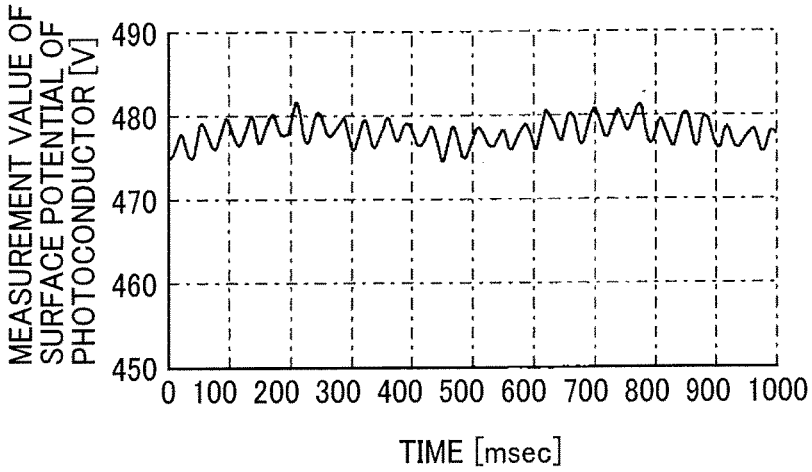
FIG. 3 is a graph illustrating temporal changes in a surface potential detected by a surface potential sensor in a first experiment.

FIG. 3 is a graph illustrating temporal changes in a surface potential detected by the surface potential sensor 8K in the first experiment. As illustrated in FIG. 3, although the surface potential of the photoconductor 1K is uniform, the detection result of the surface potential greatly fluctuated. The fluctuation range of the detection result in one second was about 7.5 [V]. Such a large fluctuation of the detection result hinders accurate detection of the surface potential of the photoconductor and makes it difficult to keep the background potential and latent image potential of the photoconductor at the target potential.

Second Experiment

While the test printer was idling, output data from the surface potential sensor 8K in the image forming unit for black was sampled. The developing bias that was only a direct current voltage of minus polarity was applied to the first developing roller 41K and the second developing roller 42K in the developing device 4K for black.

Figure 4:
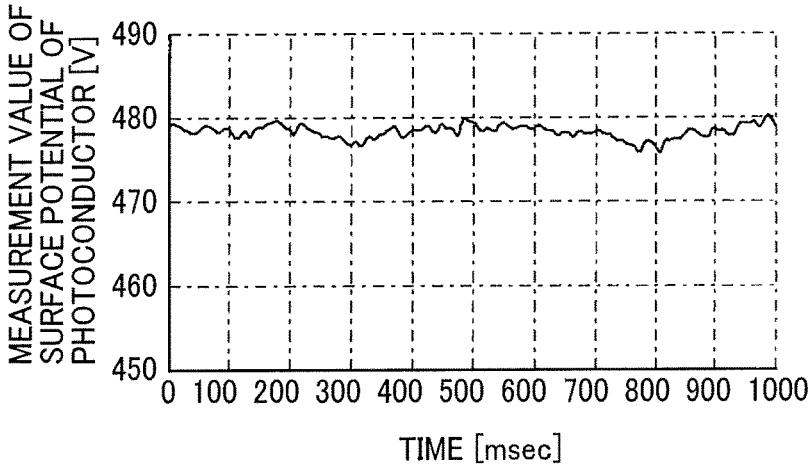
FIG. 4 is a graph illustrating temporal changes in a surface potential detected by a surface potential sensor in a second experiment.

FIG. 4 is a graph illustrating temporal changes in a surface potential detected by the surface potential sensor 8K in the second experiment. With reference to FIG. 3 and FIG. 4, in comparison between the first experiment illustrated in FIG. 3 and the second experiment, it was confirmed that the temporal variation of the detection result of the surface potential by the surface potential sensor 8K was considerably reduced in the second experiment. In the second experiment, the fluctuation range of the detection result in one second was about 4.3 [V]. Since the allowable range of the fluctuation range is within 5.0 [V], the detection error of the surface potential can be kept within the allowable range under the condition of the second experiment.

Third Experiment

While the test printer was idling, output data from the surface potential sensor 8K in the image forming unit for black was sampled. The developing bias that was the superimposed voltage was applied to the first developing roller 41K and the second developing roller 42K in the developing device 4K for black. The following condition was satisfied with respect to the frequency fc of the AC component of the developing bias and the drive frequency fvsen of the tuning fork vibrator 47 of the surface potential sensor 8K.

That is, the condition is "fc=fvsen×12+100". The characteristic of the developing bias in the third experiment is the same as the developing bias in the first experiment except that the frequency fc is different from the developing bias in the first experiment.

Figure 5:
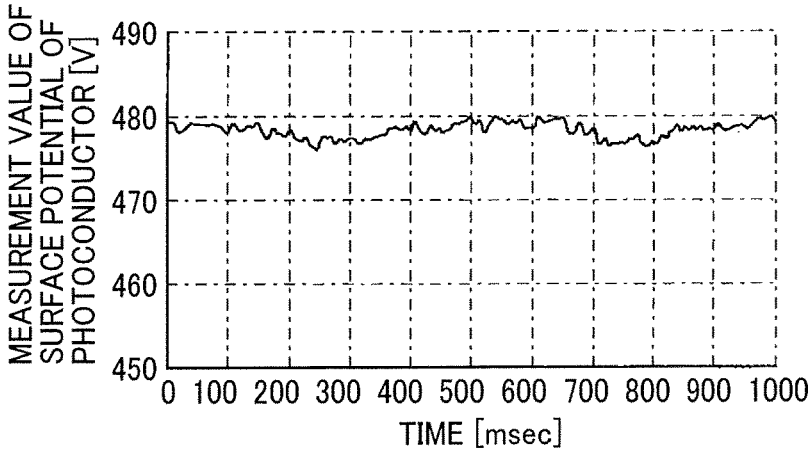
FIG. 5 is a graph illustrating temporal changes in a surface potential detected by a surface potential sensor in a third experiment.

FIG. 5 is a graph illustrating temporal changes in a surface potential detected by the surface potential sensor 8K in the third experiment. With reference to FIG. 3 and FIG. 5, in comparison between the first experiment illustrated in FIG. 3 and the third experiment, it was confirmed that the temporal variation of the detection result of the surface potential by the surface potential sensor 8K was considerably reduced in the third experiment. In the third experiment, the fluctuation range of the detection result in one second was about 3.9 [V]. This fluctuation range is within the allowable range of the detection error of the surface potential. Unlike in the second experiment, despite employing the superposed voltage as the developing bias, the fluctuation range of the detection result became smaller than the fluctuation range in the second experiment.

The difference between the first experiment and the third experiment is only the relation between the frequency fc of the AC component of the developing bias and the drive frequency fvsen of the tuning fork vibrator 47 of the surface potential sensor 8K. In the first experiment, the condition "fc=fvsen×natural number (specifically, 12)" is satisfied, whereas in the second experiment or the third experiment, the condition is not satisfied. This leads to the following reason why the detection result of the surface potential is greatly varied in the first experiment. That is, the interference between the periodic fluctuation wave of the electric field formed around the detection electrode of the surface potential sensor 8K and the periodic fluctuation wave of the electric field formed by the AC component of the developing bias causes the fluctuation in the output from the surface potential sensor 8.

Figure 6:
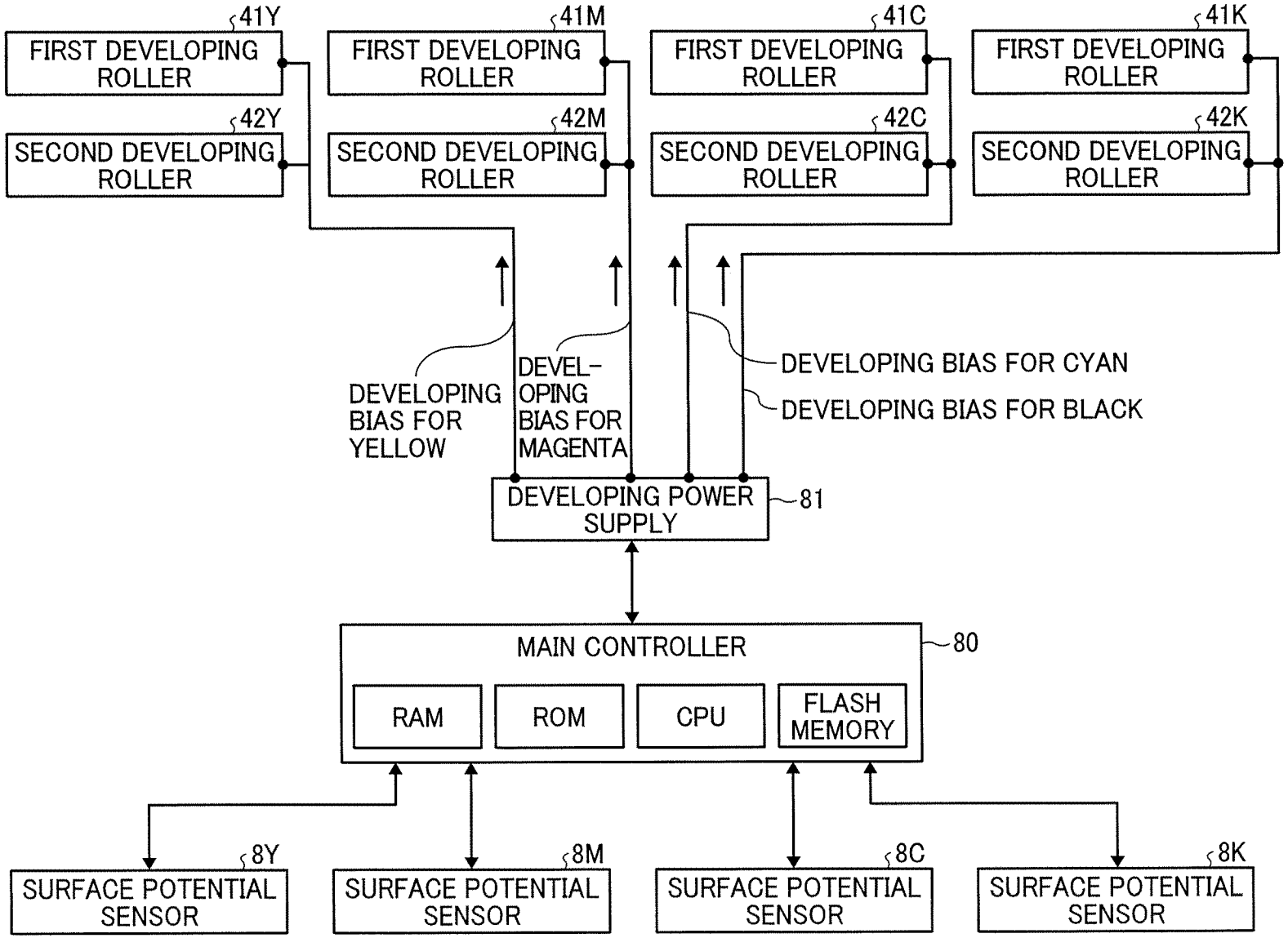
FIG. 6 is a block diagram illustrating part of the electrical circuitry of the printer illustrated in FIG. 1.

FIG. 6 is a block diagram of a portion of an electrical circuit of the printer according to the present embodiment. In FIG. 6, a main controller 80 including a random-access memory (RAM), a read only memory (ROM), a central processing unit (CPU), a flash memory, and the like controls driving of each device of the printer and performs various arithmetic processing. A developing power supply 81 separately outputs developing biases applied to the first developing rollers 41Y, 41M, 41C, and 41 K and the second developing rollers 42Y, 42M, 42C, and 42 K in each of the developing devices for yellow, magenta, cyan, and black. The developing power supply 81 that applies the developing bias to the developer bearer can separately change the direct current component of the developing bias for each of the colors yellow, magenta, cyan, and black based on a signal sent from the main controller 80.

The designed value of the drive frequency fvsen of the tuning fork vibrator 47 in the surface potential sensors 8Y, 8M, 8C, and 8K for yellow, magenta, cyan, and black is fixed at 700 Hz, but, in fact, there is a case error which shifts the drive frequency by about −50 [Hz] to +50 [Hz] from the designed value. Therefore, generally, the drive frequencies fvsen are slightly different between the surface potential sensors for yellow, magenta, cyan, and black. Manufacturers of the surface potential sensors 8Y, 8M, 8C, and 8K measure the drive frequency fvsen of each product at the time of factory shipment and attach a sheet describing the results to the product.

In the developing devices of each color of yellow, magenta, cyan, and black of this printer, the frequency fc of the AC component of the developing bias is not a multiple of the drive frequency fvsen, and the frequency fc is a value obtained by adding a predetermined value to a multiple of the drive frequency fvsen. Specifically, the frequency fc satisfies the condition "frequency fc≠drive frequency fvsen×n" and the condition "fc=fvsen×n+m" (n is a natural number, m is a natural number smaller than the drive frequency fvsen). Therefore, the printer is shipped with the frequency fc of the developing bias for yellow, magenta, cyan, and black outputted from the developing power supply 81 finely adjusted to satisfy the above-described conditions.

In each of the surface potential sensors 8Y, 8M, 8C, and 8K for yellow, magenta, cyan, and black, the above-described conditions reduce the interference between the periodic fluctuation wave of the electric field formed around the detection electrode of the surface potential sensor and the periodic fluctuation wave of the electric field formed by the AC component of the developing bias. Reducing the interference enables to decrease a detection error of the surface potential caused by setting the frequency of AC component of the developing bias to the unsuitable value that promotes the interference. In addition, keeping the detection error within the allowable range without covering the surface potential sensors 8Y, 8M, 8C, and 8 K with the electromagnetic shield makes it possible to avoid unnecessary cost increase.

The drive frequency fvsen and the frequency fc in the above conditions are values obtained by rounding off the decimal point.

Figure 7:
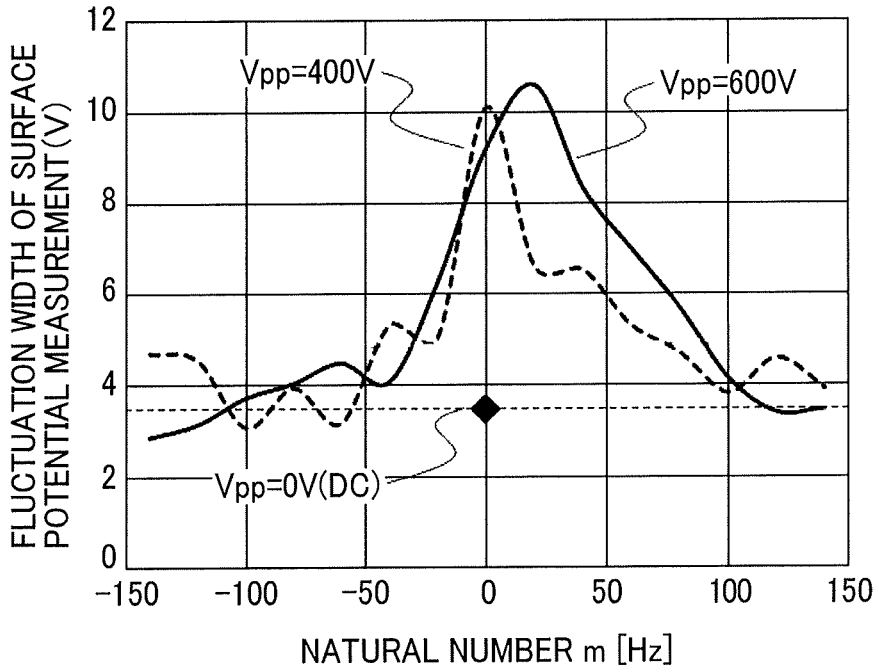
FIG. 7 is a graph illustrating a desirable value of natural number m.

The natural number m in the above condition indicates how far the frequency fc of the AC component in the developing bias is from the center of interference. Setting the natural number m to an appropriate value enables suppression of the fluctuation range of the detection result of the surface potential to a value as small as the case of employing the developing bias that is only the DC voltage. The appropriate value varies depending on the peak-to-peak value Vpp of the AC component, and the like. For example, in an example illustrated in FIG. 7 in which the peak-to-peak value Vpp is 400 [V], setting the natural number m to a number from about −60 [Hz] to about −100 [Hz] can make the fluctuation range smaller than or equal to the fluctuation range when the developing bias is only DC voltage. In case in which the peak-to-peak value Vpp is 600 [V], setting the natural number m to a number about 125 [Hz] can make the fluctuation range smaller than or equal to the fluctuation range when the developing bias is only DC voltage.

FIG. 8 is a block diagram illustrating a developing power supply 81 of the printer and developing rollers of respective colors according to the example. The developing power supply 81 includes a power supply substrate for yellow and magenta 82YM as a power supply circuit substrate and a power supply substrate for cyan and black 82CK as a power supply circuit substrate. The power supply substrate for yellow and magenta 82YM separately outputs developing biases to be applied to the first developing roller for yellow 41Y, the second developing roller for yellow 42Y, the first developing roller for magenta 41M, and the second developing roller for magenta 42M, respectively. Additionally, the power supply substrate for cyan and black 82CK separately outputs developing biases to be applied to the first developing roller for cyan 41C, the second developing roller for cyan 42C, the first developing roller for black 41K, and the second developing roller for black 42K, respectively.

The power supply substrate for yellow and magenta 82YM includes a direct current power supply circuit for yellow 83Y to output a direct current component of the developing bias for yellow and a direct current power supply circuit for magenta 83M to output a direct current component of the developing bias for magenta. In addition, the power supply substrate for yellow and magenta 82YM includes an AC power supply circuit for yellow and magenta 86 fluctuation YM to output AC component (that is expressed by, for example, frequency) of the developing bias used for yellow and magenta. Using one AC power supply circuit for yellow and magenta 86YM in common enables to output the same AC component that is the same frequency and achieve cost reduction. The power supply substrate for cyan and black 82CK also includes a direct current power supply circuit for only cyan 83C, a direct current power supply circuit for only black 83K, and one AC power supply circuit for cyan and black 86CK in common.

Each of the DC power supply circuits 83Y, 83M, 83C, and 83K for each color includes output circuits 84Y, 84M, 84C, and 84K and output adjustment circuits 85Y, 85M, 85C, and 85K. The main controller 80 in FIG. 6 separately outputs control signals to each of the output adjustment circuits for yellow, magenta, cyan, and black 85Y, 85M, 85C, and 85K, respectively, so that the plurality of output circuits 84Y, 84M, 84C, and 84K can output different DC voltages. This enables to adjust the direct current voltage output for each color.

The AC power supply circuit for yellow and magenta 86YM and the AC power supply circuit for cyan and black 86CK include output circuits 87YM and 87CK and frequency adjustment circuits 88YM and 88CK. The main controller 80 separately outputs each of control signals to the frequency adjustment circuit for yellow and magenta 88YM and the frequency adjustment circuit for cyan and black 88CK, respectively. This enables to adjust an alternating current voltage frequency fc output from the output circuit for yellow and magenta 87YM and an alternating current voltage frequency fc output from the output circuit for cyan and black 87CK, respectively.

Due to the above-described case error, the drive frequency fvsen is generally different between the surface potential sensor 8Y for yellow and the surface potential sensor 8M for magenta. On the other hand, the AC power supply circuit 86YM for yellow and magenta is used in common. Therefore, the frequency fc of the alternating current voltage output from the AC power supply circuit 86YM for yellow and magenta is set to a value that satisfies the above conditions in both the drive frequency fvsen of the surface potential sensor 8Y for yellow and the drive frequency fvsen of the surface potential sensor 8M for magenta. Specifically, the frequency fc is set to a value that satisfies the condition of "frequency fc≠drive frequency fvsen×n" and the condition of "fc=fvsen×n+m" for each of both the driving frequencies fvsen. Similarly, the frequency fc of the alternating current voltage output from the AC power supply circuit 86CK for cyan and black is set to a value that satisfies the above conditions in both the drive frequency fvsen of the surface potential sensor 8C for cyan and the drive frequency fvsen of the surface potential sensor 8K for black.

In the printer according to the embodiment, the frequency fc of the AC voltage output from the AC power supply circuit for yellow, magenta, cyan, and black is manually adjusted to the value corresponding to the drive frequency fvsen for yellow, magenta, cyan, and black. In contrast, in the printer according to the example, the main controller automatically sets the frequency fc of the AC voltage output from the AC power supply circuit 86YM for yellow and magenta to a value corresponding to the drive frequencies fvsen for yellow and magenta. Further, the main controller automatically sets the frequency fc of the AC voltage output from the AC power supply circuit 86CK for cyan and black to a value corresponding to the drive frequencies fvsen for cyan and black. For that purpose, the data table as illustrated in FIG. 9 is stored in the storage circuit such as a ROM.

The main controller uses this data table to set the frequency fc of the AC voltage output from the AC power supply circuit 86CK for cyan and black to the value corresponding to the drive frequencies fvsen for cyan and black. The storage circuit stores similar data tables for yellow and magenta.

When the worker inputs the drive frequency fvsen for cyan and the drive frequency fvsen for black by the controller, the main controller specifies the frequency fc corresponding to the combination of the two drive frequencies fvsen from the data table in FIG. 9. Thereafter, the main controller outputs the control signal to output the AC voltage of the specified frequency fc from the AC power supply circuit 86CK for cyan and black. This eliminates setting of the frequency fc by the worker and improves productivity.

It is desirable to set the natural number m to a value of 100 or more. Therefore, in the data table of FIG. 9, the natural number m is set to a value of 100 or more. For example, when the drive frequency fvsen for black is 702 [Hz] and the drive frequency fvsen for cyan is 686 [Hz], based on the data table in FIG. 9, 8800 [Hz] corresponding to B in FIG. 9 is selected as the specified frequency fc. Since this frequency fc=8800 [Hz] is 702 [Hz]×12+376 in the above-described condition for black, the natural number m for black is 376. Similarly, since the frequency fc=8800 [Hz] is 686 [Hz]×12+586 in the above-described condition for cyan, the natural number m for cyan is 586.

The exemplary embodiments described above are one example and attain advantages below in a plurality of aspects A to H.

Aspect A

An image forming apparatus according to the aspect A includes a latent image carrier such as the photoconductors 1Y, 1M, 1C, and 1K that bears a latent image, a potential sensor such as the surface potential sensors 8Y, 8M, 8C, and 8K having a vibrator 47 driven by a drive frequency fvsen to detect a surface potential of the latent image bearer, a developer bearer such as the first developing roller 41Y, 41M, 41C, and 41K to bear developer that develops the latent image on the latent image bearer, and a power supply such as the developing power supply 81 to apply a superimposed voltage obtained by superimposing an alternating voltage on a direct current voltage on the developer bearer. The frequency fc of the alternating voltage is not a multiple of the drive frequency fvsen and is a value obtained by adding a predetermined value to a multiple of the driving frequency fvsen.

The frequency fc that is a multiple of the driving frequency fvsen of the potential sensor causes large interference between the periodic fluctuation wave of the electric field formed around the vibrator 47 of the potential sensor and the periodic fluctuation wave of the electric field formed around the developer bearer by the alternating current component of the superimposed voltage. This interference significantly deteriorates the detection accuracy of the potential sensor. Therefore, in the aspect A, the frequency fc of the alternating current component of the superposed voltage is set to a value different from the multiple of the drive frequency fvsen of the vibrator 47 of the potential sensor. This reduces the interference and the detection error of the surface potential by the potential sensor caused by the frequency fc being an inappropriate value.

Aspect B

In the aspect B, the image forming apparatus according to aspect A includes a plurality of sets of the latent image bearer, the potential sensor, and the developer bearer. More specifically, the plurality of sets use a common alternating current power circuit that outputs the alternating current voltage and have the aspect A in each of the drive frequencies fvsen and the frequencies fc of the plurality of sets of the potential sensors. This reduces the detection error of the surface potential by the potential sensor caused by the frequency fc being an inappropriate value in each of the plurality of sets.

Aspect C

In the aspect C, the image forming apparatus according to the aspect B includes the power supply that applies the alternating current voltage of the same frequency fc to the plurality of developer bearers. This reduces the detection error of the potential sensor caused by the electric field formed around the developer bearer that is applied the superimposed voltage and cost by using a common alternating current power circuit of the power supply in the plurality of the developer bearer.

Aspect D

In the aspect D, the image forming apparatus according to the aspect C includes the power supply having one alternating current power circuit to output the alternating current voltage of the same frequency fc applied to at least the two developer bearers, which are, for example, the developer bearers for yellow and magenta or the developer bearers for cyan and black. In this aspect D, one common alternating current power circuit reduces the detection error of the potential sensor corresponding to each of the plurality of the developer bearers.

Aspect E

In the aspect E, the image forming apparatus according to the aspect B includes the power supply that separately applies the direct current voltage to the plurality of developer bearers. This aspect enables to stabilize the image density by separately adjusting the developing potential which is the potential difference between the latent image of the latent image bearer and the developer bearer in each of the plurality of developer bearers.

Aspect F

In the aspect F, the image forming apparatus according to the aspect E includes the power supply having a plurality of direct current power circuits that separately apply the direct current voltage to the plurality of developer bearers. In this aspect, the plurality of direct current power circuits can separately output the direct current voltage to each of the plurality of developer bearers.

Aspect G

In the aspect G, the image forming apparatus according to the aspect B includes the power supply comprising one power supply circuit substrate including one alternating current power circuit (ex. 86YM and 86CK) to output the alternating current voltage of the same frequency fc applied to at least the two developer bearers and a plurality of direct current power circuits (ex. 83Y, 83M, 83C, 83K) that separately output the direct current voltage to the plurality of developer bearers. With such a configuration, mounting a plurality of direct current power circuits on one power circuit substrate (ex, 82YM and 82CK) can save space.

Aspect H

The aspect H is a method of applying a voltage of the image forming apparatus including the potential sensor that has the vibrator 47 driven by the drive frequency fvsen and the developer bearer applied the superimposed voltage obtained by superimposing the alternating current voltage on the direct current voltage. The method includes setting a frequency fc of the alternating current voltage that is not a multiple of the drive frequency fvsen and is a value obtained by adding a predetermined value to a multiple of the drive frequency fvsen.

The above-described embodiments and variations are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits. A processing circuit includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

Each of the functions of the described embodiments may be implemented by a computer program which is stored in a non-transitory recording medium such as the ROM or the RAM.

What is claimed is:

1. An image forming apparatus, comprising:

a latent image bearer to bear a latent image;

a potential sensor having a vibrator driven at a drive frequency to detect a surface potential of the latent image bearer;

a developer bearer to bear developer that develops the latent image on the latent image bearer; and a power supply to apply a superimposed voltage obtained by superimposing an alternating voltage on a direct current voltage to the developer bearer, wherein a frequency of the alternating current voltage is not a multiple of the drive frequency, but is a value obtained by adding a predetermined constant value to a multiple of the drive frequency.

2. The image forming apparatus according to claim 1, further comprising a plurality of sets of the latent image bearer, the potential sensor, and the developer bearer.

3. The image forming apparatus according to claim 2, wherein the power supply applies the alternating current voltage of a same frequency to the plurality of developer bearers.

4. The image forming apparatus according to claim 3, wherein the power supply includes one alternating current power circuit to output the alternating current voltage of the same frequency applied to the plurality of developer bearers.

5. The image forming apparatus according to claim 2, wherein the power supply separately applies the direct current voltage to the plurality of developer bearers.

6. The image forming apparatus according to claim 5, wherein the power supply includes a plurality of direct current power circuits that separately apply the direct current voltage to the plurality of developer bearers.

7. The image forming apparatus according to claim 2, wherein the power supply comprises one power supply circuit substrate including:

one alternating current power circuit to output the alternating current voltage of a same frequency applied to the plurality of developer bearers; and a plurality of direct current power circuits that separately output the direct current voltage to the plurality of developer bearers.

8. The image forming apparatus according to claim 1, wherein the potential sensor is not covered with an electromagnetic shield.

9. The image forming apparatus according to claim 1, wherein the vibrator of the potential sensor is a tuning fork type vibrator.

10. The image forming apparatus according to claim 1, wherein the frequency of the alternating current voltage is (n times the drive frequency)+m, wherein n is a natural number, and m is a natural number smaller than the drive frequency.

11. The image forming apparatus according to claim 10, wherein the natural number m indicates how far the frequency of the alternating current voltage is from a center of interference.

12. The image forming apparatus according to claim 10, wherein the natural number m is at least 100.

13. A voltage application method for an image forming apparatus that includes a potential sensor having a vibrator driven by a drive frequency and a developer bearer supplied with a superimposed voltage obtained by superimposing an alternating current voltage on a direct current voltage, the voltage application method comprising:

setting a frequency of the alternating current voltage that is not a multiple of the drive frequency, but is a value obtained by adding a predetermined constant value to a multiple of the drive frequency.

14. The voltage application method according to claim 13, wherein the potential sensor is not covered with an electromagnetic shield.

15. The voltage application method according to claim 13, wherein the vibrator of the potential sensor is a tuning fork type vibrator.

16. The voltage application method according to claim 13, wherein the frequency of the alternating current voltage is (n times the drive frequency)+m, wherein n is a natural number, and m is a natural number smaller than the drive frequency.

17. The voltage application method according to claim 16, wherein the natural number m indicates how far the frequency of the alternating current voltage is from a center of interference.

18. The voltage application method according to claim 16, wherein the natural number m is at least 100.

* * * * *